US012650238B2

(12) United States Patent
Kavanagh

(10) Patent No.: US 12,650,238 B2
(45) Date of Patent: Jun. 9, 2026

(54) HVAC DYNAMIC AIR VOLUME CORRECTION

(71) Applicant: FrostFire Services Inc., Calgary (CA)

(72) Inventor: Wayne Andrew Kavanagh, Calgary (CA)

(73) Assignee: FrostFire Services Inc., Calgary (CA)

( * ) Notice: Subject to any disclaimer, the term of this patent is extended or adjusted under 35 U.S.C. 154(b) by 128 days.

(21) Appl. No.: 18/817,642

(22) Filed: Aug. 28, 2024

(65) Prior Publication Data

US 2025/0075932 A1 Mar. 6, 2025

Related U.S. Application Data

(60) Provisional application No. 63/534,948, filed on Aug. 28, 2023.

(51) Int. Cl.

| | |
|---|---|
| ***F25B 49/02*** | (2006.01) |
| ***F24F 11/76*** | (2018.01) |
| ***F24F 11/81*** | (2018.01) |
| *F24F 110/10* | (2018.01) |

(52) U.S. Cl.

CPC ..... *F24F 11/76* (2018.01); *F24F 11/81* (2018.01); *F24F 2110/10* (2018.01)

(58) Field of Classification Search

CPC ..... F25B 2500/19; F25B 2600/11; F25B 2600/111; F25B 2600/112

See application file for complete search history.

(56) References Cited

U.S. PATENT DOCUMENTS

| | | | | |
|---|---|---|---|---|
| 11,644,215 | B2 * | 5/2023 | Glanzer | F24F 11/84 165/293 |
| 2005/0178132 | A1 * | 8/2005 | Sakaguchi | F25B 49/027 62/181 |
| 2019/0049121 | A1 * | 2/2019 | Jones | F24F 11/76 |

FOREIGN PATENT DOCUMENTS

| | | | | |
|---|---|---|---|---|
| EP | 3511639 | A1 * | 7/2019 | F24F 11/77 |

* cited by examiner

*Primary Examiner* — Jonathan Bradford

(74) *Attorney, Agent, or Firm* — Snyder, Clark, Lesch & Chung, LLP

(57) ABSTRACT

An HVAC volume correction controller for a building's HVAC system, and an associated method, for dynamically modulating the volumetric airflow rate entering the building to account for the thermal expansion of air through a blow through heat exchanger. The HVAC volume correction controller: (i) calculates a temperature differential between an air discharge temperature and an air intake temperature; (ii) calculates a volume correction factor, taking into account the thermal expansion coefficient of air and the temperature differential; and (iii) modifies a blower motor speed of the blow through heat exchanger. The HVAC volume correction controller can be retrofitted on existing HVAC systems, or can be integrated with a blow through heat exchanger for new installations.

18 Claims, 7 Drawing Sheets

HVAC DYNAMIC AIR VOLUME CORRECTION

RELATED APPLICATION

This application claims priority under 35 U.S.C. § 119 based on U.S. provisional application No. 63/534,948 filed Aug. 28, 2023, titled "HVAC DYNAMIC AIR VOLUME CORRECTION", the disclosure of which is hereby incorporated herein by reference in its entirety.

TECHNICAL FIELD

The invention relates to heating, ventilating, and air conditioning (HVAC) control systems and methods, specifically control systems and methods for reducing the energy consumption of HVAC systems.

BACKGROUND OF THE ART

Buildings, including residential, commercial or industrial buildings, require fresh outside air to help control odors, humidity and the build-up of other potential harmful gases. In multi-unit residential buildings, fresh air, or make-up air for hallways and corridors is typically provided by a HVAC system (also referred to as hallway pressurization unit). The primary function of the hallway pressurization unit is to maintain the building envelope (i.e., maintain a set pressure within the building).

HVAC systems are commonly used to ventilate, heat and/or cool interior spaces in buildings, for example rooms, and in particular rooms occupied by people. HVAC systems use ducting and at least one blower to deliver the outside air to the interior spaces. Typically, HVAC systems include a blower that operates at a constant speed (expressed in rotation per minute or RPM) and use dampers (i.e., valves or plates) to control the flow of air (or volumetric airflow rate expressed cubic feet per minute or CFM) into a building. Dampers work by opening or closing to varying degrees in ducting in order to control the flow of air. Although the blower may be located in various locations of the building, residential and commercial applications frequently use HVAC rooftop units with the blower located on the building's roof.

HVAC systems also typically include a heat exchanger which is used to exchange heat, or thermal energy, with the outside air entering the building through the HVAC system. In other words, the heat exchanger can either heat or cool the outside air being delivered to the interior spaces. In this context, HVAC systems define a discharge air setpoint, which corresponds to the temperature of the air being discharged from the HVAC system into the interior spaces. HVAC systems either heat or cool the outside air entering the building depending on both the discharge air setpoint and the temperature of the outside air.

HVAC systems are typically air balanced at around 20 degrees Celsius (° C.) (or 68 degrees Fahrenheit (° F.)), which means that if the discharge air setpoint is set to 20° C. and the outside air is at 20° C., no expansion of the air occurs as the outside air is pushed through or around the heat exchanger. In other words, the volume of outside air that passes inside or around the heat exchanger is equal to the volume of air that is discharged in the interior space of the building by the heat exchanger.

However, if the outside air is at a temperature below 20° C. and the discharge air setpoint is set to 20° C., then the outside air is heated and expands as it comes into contact with the heat exchanger. For example, if the outside air is at a temperature of 0° C. (or 32° F.) and the discharge air setpoint is set to 20° C., the heat exchanger transfers thermal energy to the outside air as the outside air is being pushed through the heat exchanger. As the outside air is heated, it also undergoes thermal expansion across the heat exchanger (i.e., the volume of air being heated increases). For example, assuming: (i) an intake volumetric airflow rate of 1000 CFM of outside air at 0° C.; (ii) a discharge air setpoint of 20° C.; and (iii) a volume correction factor of 1000 CFM/0.93 for a rise in temperature of +20° C. inside the heat exchanger, then the discharge volumetric airflow rate is 1075 CFM. In this case, both the blower and the heat exchanger have used more energy than necessary and over delivered (and heated) 75 CFM. In this example, the HVAC system has now provided more air than required to the building. This is referred to as "over delivering".

Some HVAC systems are designed to reduce the volumetric airflow rate through the heat exchanger by partially closing the outside air dampers and adding static pressure to the system (static pressure being defined as the resistance encountered by air as it travels through the HVAC system). In these systems, the dampers are mechanically adjustable and may alternate between two set positions, or a position of the dampers may be modulated. This mechanism is referred to as "ambient compensation", however is only performed to compensate for the lack of burner capacity of the heat exchanger on the coldest days (i.e., the load on the burner is reduced as the burner lacks the required capacity to heat cold air). Ambient compensation does not take energy savings into account and does not account for the thermal expansion of air through the heat exchanger.

Although other systems provide a wider range of positions for the dampers, these systems are still vulnerable to mechanical malfunction, jamming, corrosion, fouling and inefficient power consumption. In addition, these systems generally lack the precision required to achieve accurate airflow.

Accordingly, there remains a need to provide HVAC systems that address at least some of the shortcomings discussed above.

SUMMARY

In accordance with a broad aspect of the present technology, there is provided a method of operating a HVAC system for a building defining an interior airspace, the HVAC system comprising a HVAC system blower and a blow through heat exchanger. The HVAC system blower has a HVAC system blower motor. The method is executed by at least one controller operatively connected to the HVAC system. The method comprises calculating a temperature differential between a temperature at a discharge region of the blow through heat exchanger and a temperature at an intake region of the blow through heat exchanger; calculating a volume correction factor based on the calculated temperature differential, wherein the volume correction factor accounts for the thermal expansion of air within the temperature differential; calculating a modified motor speed according to the volume correction factor; and transmitting a signal comprising an indication of the modified motor speed to cause a modification of a speed of the HVAC system blower motor.

In one or more embodiments of the method of operating the HVAC system, the temperature at the intake region of the blow through heat exchanger is acquired using an intake temperature sensor.

In one or more embodiments of the method of operating the HVAC system, the intake temperature sensor is located in an intake region of the blow through heat exchanger.

In one or more embodiments of the method of operating the HVAC system, the HVAC system recirculates at least a portion of the air of the interior airspace towards the intake region.

In one or more embodiments of the method of operating the HVAC system, the temperature at the intake region of the blow through heat exchanger is acquired at a sampling rate between 0.1 second and 10 seconds.

In one or more embodiments of the method of operating the HVAC system, the temperature at the intake region of the blow through heat exchanger is acquired at a sampling rate of 1 second.

In one or more embodiments of the method of operating the HVAC system, the temperature at the discharge region of the blow through heat exchanger is determined using a temperature setpoint of the interior airspace of the building.

In one or more embodiments of the method of operating the HVAC system, the temperature setpoint of the interior airspace of the building is defined by a user.

In one or more embodiments of the method of operating the HVAC system, the temperature at the discharge region of the blow through heat exchanger is acquired using a discharge temperature sensor.

In one or more embodiments of the method of operating the HVAC system, the discharge temperature sensor is located in the discharge region of the blow through heat exchanger.

In one or more embodiments of the method of operating the HVAC system, the temperature at the discharge region of the blow through heat exchanger is acquired at a sampling rate between 0.1 second and 10 seconds.

In one or more embodiments of the method of operating the HVAC system, the temperature at the discharge region of the blow through heat exchanger is acquired at a sampling rate of 1 second.

In one or more embodiments of the method of operating the HVAC system, the volume correction factor is calculated using the following formula:

$$\text{volume correction factor} = \text{temperature differential} * \text{thermal expansion coefficient}$$

In one or more embodiments of the method of operating the HVAC system, the thermal expansion coefficient is 0.00225/° F.

In one or more embodiments of the method of operating the HVAC system, the modified motor speed is calculated using the following formula:

$$\text{modified motor speed} = (1 - \text{volume correction factor}) * 100$$

In one or more embodiments of the method of operating the HVAC system, the at least one controller transmits the signal comprising an indication of the modified motor speed to a variable frequency drive, the variable frequency drive being operatively connected to the HVAC system blower to cause modification of the speed of the HVAC system blower motor.

In one or more embodiments of the method of operating the HVAC system, the variable frequency drive causes modification of the HVAC system blower motor speed by modulating a DC pulse frequency outputted by the variable frequency drive according to the volume correction factor.

In accordance with another broad aspect of the present technology, there is provided a volume correction controller for a HVAC system for a building defining an interior airspace, the HVAC system comprising a HVAC system blower and a blow through heat exchanger. The HVAC system blower has a HVAC system blower motor. The volume correction controller comprises:

- a communication interface operatively connected to the HVAC system;
- a non-transitory storage medium, the non-transitory storage medium storing computer-readable instructions thereon; and
- a processing unit operatively connected to the non-transitory storage medium and the communication interface.

The processing unit, upon executing the computer-readable instructions, is configured for calculating a temperature differential between a temperature at a discharge region of the blow through heat exchanger and a temperature at an intake region of the blow through heat exchanger; calculating a volume correction factor based on the calculated temperature differential, wherein the volume correction factor accounts for the thermal expansion of air within the temperature differential; calculating a modified motor speed according to the volume correction factor; and transmitting a signal comprising an indication of the modified motor speed to cause modification of a speed of the HVAC system blower motor.

In one or more embodiments of the volume correction controller, the communication interface is operatively connected to an intake temperature sensor configured to acquire the temperature at the intake region of the blow through heat exchanger.

In one or more embodiments of the volume correction controller, the intake temperature sensor is located in an intake region of the blow through heat exchanger.

In one or more embodiments of the volume correction controller, the HVAC system recirculates at least a portion of the air of the interior airspace towards the intake region.

In one or more embodiments of the volume correction controller, the temperature at the intake region of the blow through heat exchanger is acquired at a sampling rate between 0.1 second and 10 seconds.

In one or more embodiments of the volume correction controller, the temperature at the intake region of the blow through heat exchanger is acquired at a sampling rate of 1 second.

In one or more embodiments of the volume correction controller, the processing unit, upon executing the computer-readable instructions, is configured for storing the temperature at the intake region of the blow through heat exchanger in the non-transitory storage medium.

In one or more embodiments of the volume correction controller, the communication interface is operatively connected to a controller of the HVAC system, the controller of the HVAC system being configured to define a temperature setpoint of the interior airspace of the building.

In one or more embodiments of the volume correction controller, the temperature at the discharge region of the blow through heat exchanger is determined using the temperature setpoint of the interior airspace of the building.

In one or more embodiments of the volume correction controller, the communication interface is operatively connected to a discharge temperature sensor configured to acquire the temperature at the discharge region of the blow through heat exchanger.

In one or more embodiments of the volume correction controller, the discharge temperature sensor is located in the discharge region of the blow through heat exchanger.

In one or more embodiments of the volume correction controller, the temperature at the discharge region of the blow through heat exchanger is acquired at a sampling rate between 0.1 second and 10 seconds.

In one or more embodiments of the volume correction controller, the temperature at the discharge region of the blow through heat exchanger is acquired at a sampling rate of 1 second.

In one or more embodiments of the volume correction controller, the processing unit, upon executing the computer-readable instructions, is configured for storing the temperature at the discharge region of the blow through heat exchanger in the non-transitory storage medium.

In one or more embodiments of the volume correction controller, the processing unit, upon executing the computer-readable instructions, is configured for calculating the volume correction factor using the following formula:

volume correction factor=temperature differential*thermal expansion coefficient

In one or more embodiments of the volume correction controller, the thermal expansion coefficient is stored in the non-transitory storage medium.

In one or more embodiments of the volume correction controller, the thermal expansion coefficient is 0.00225/° F.

In one or more embodiments of the volume correction controller, the processing unit, upon executing the computer-readable instructions, is configured for calculating the modified motor speed using the following formula:

$$\text{modified motor speed} = (1 - \text{volume correction factor}) * 100$$

In one or more embodiments of the volume correction controller, the communication interface is operatively connected to a variable frequency drive and is configured to transmit an indication of the modified blower motor speed to the variable frequency drive, the variable frequency drive being operatively connected to the HVAC system blower motor to cause modification of the speed of the HVAC system blower motor.

In one or more embodiments of the volume correction controller, the variable frequency drive modifies the speed of the HVAC system blower motor by modulating a DC pulse frequency outputted by the variable frequency drive according to the volume correction factor.

In one or more embodiments of the volume correction controller, the volume correction controller further comprises a housing.

In one or more embodiments of the volume correction controller, the non-transitory storage medium, the processor and the variable frequency drive are housed in the housing.

BRIEF DESCRIPTION OF THE DRAWINGS

Having thus generally described the nature of the invention, reference will now be made to the accompanying drawings, showing by way of illustration example embodiments thereof and in which.

DETAILED DESCRIPTION

Figure 1:
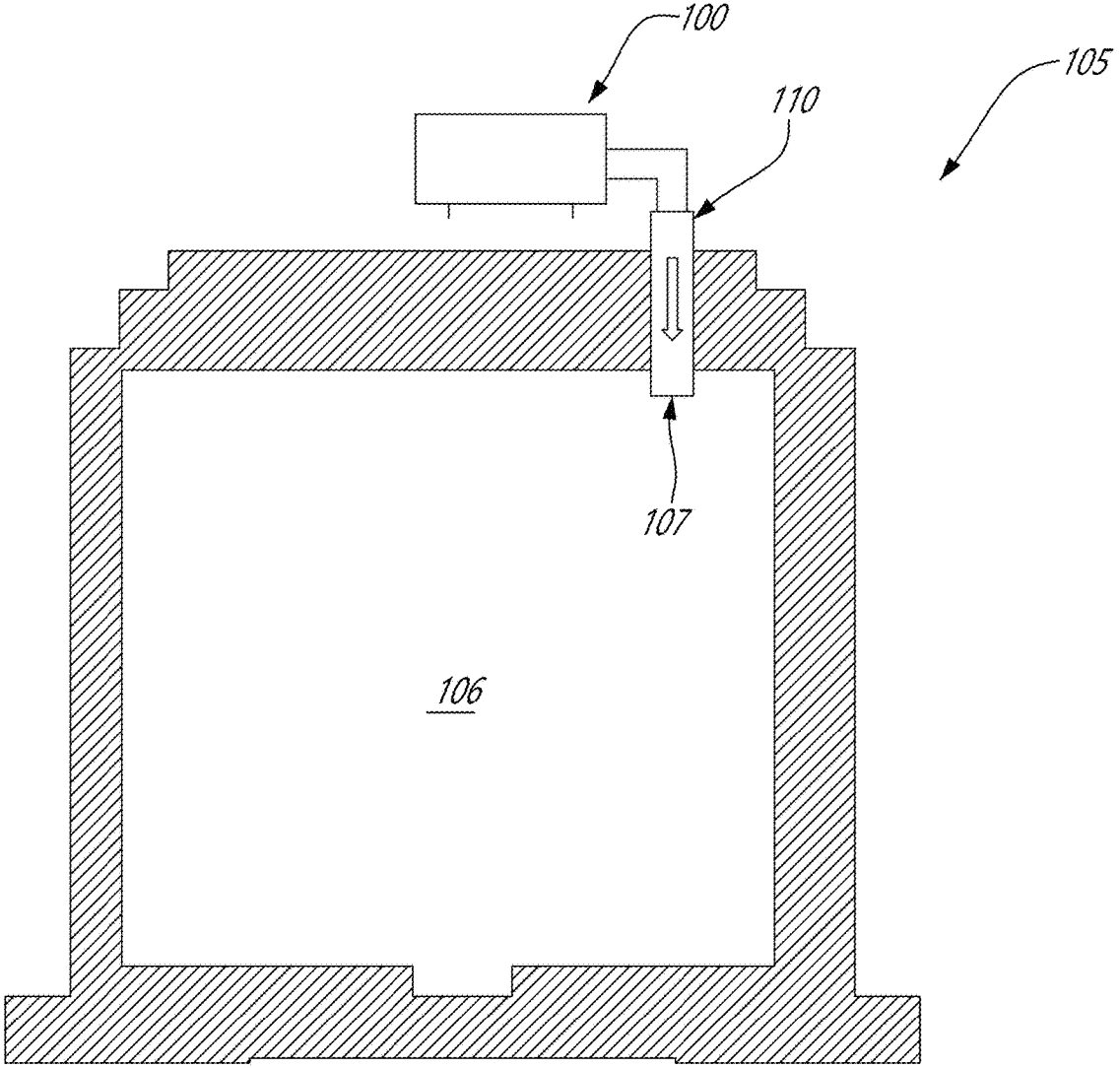
FIG. 1 is a schematic representation of a building with an HVAC system in accordance with one embodiment.

In the context of the present disclosure, the expression "computer readable storage medium" (also referred to as "storage medium" and "storage") is intended to include non-transitory media of any nature and kind whatsoever, including without limitation RAM, ROM, disks (CD-ROMs, DVDs, floppy disks, hard drivers, etc.), USB keys, solid state-drives, tape drives, etc. A plurality of components may be combined to form the computer information storage media, including two or more media components of a same type and/or two or more media components of different types.

In the context of the present disclosure, the expression "information" includes information of any nature or kind whatsoever capable of being stored in a database. Thus information includes, but is not limited to audiovisual works (images, movies, sound records, presentations etc.), data (location data, numerical data, etc.), text (opinions, comments, questions, messages, etc.), documents, spreadsheets, lists of words, etc.

In the context of the present disclosure, the expression "communication network" is intended to include a telecommunications network such as a computer network, the Internet, a telephone network, a Telex network, a TCP/IP data network (e.g., a WAN network, a LAN network, etc.), and the like. The term "communication network" includes a wired network or direct-wired connection, and wireless media such as acoustic, radio frequency (RF), infrared and other wireless media, as well as combinations of any of the above.

In the context of the present disclosure, the words "first", "second", "third", etc. have been used as adjectives only for the purpose of allowing for distinction between the nouns that they modify from one another, and not for the purpose of describing any particular relationship between those nouns. Thus, for example, it should be understood that, the use of the terms "system" and "third system" is not intended to imply any particular order, type, chronology, hierarchy or ranking (for example) of/between the system, nor is their use (by itself) intended imply that any "second system" must necessarily exist in any given situation. Further, as is discussed herein in other contexts, reference to a "first" element and a "second" element does not preclude the two elements from being the same actual real-world element. Thus, for example, in some instances, a "first" system and a "second" system may be the same software and/or hardware, in other cases they may be different software and/or hardware.

The examples and conditional language recited herein are principally intended to aid the reader in understanding the principles of the present technology and not to limit its scope to such specifically recited examples and conditions. It will be appreciated that those skilled in the art may devise various arrangements which, although not explicitly described or shown herein, nonetheless embody the principles of the present technology and are included within its spirit and scope.

Furthermore, as an aid to understanding, the following description may describe relatively simplified implementations of the present technology. As persons skilled in the art would understand, various implementations of the present technology may be of a greater complexity.

In some cases, what are believed to be helpful examples of modifications to the present technology may also be set forth. This is done merely as an aid to understanding, and, again, not to define the scope or set forth the bounds of the present technology. These modifications are not an exhaustive list, and a person skilled in the art may make other modifications while nonetheless remaining within the scope of the present technology. Further, where no examples of modifications have been set forth, it should not be interpreted that no modifications are possible and/or that what is described is the sole manner of implementing that element of the present technology.

Moreover, all statements herein reciting principles, aspects, and implementations of the present technology, as well as specific examples thereof, are intended to encompass both structural and functional equivalents thereof, whether they are currently known or developed in the future. Thus, for example, it will be appreciated by those skilled in the art that any block diagrams herein represent conceptual views of illustrative circuitry embodying the principles of the present technology. Similarly, it will be appreciated that any flowcharts, flow diagrams, state transition diagrams, pseudocode, and the like represent various processes which may be substantially represented in computer-readable media and so executed by a computer or processor, whether or not such computer or processor is explicitly shown.

With reference to FIG. 1, a building 105 is described having an HVAC system 100 in accordance with one embodiment. The building 105 includes an interior airspace 106 and the HVAC system 100 provides outside air to the interior airspace 106 through at least one building supply duct 107 connected to a supply rooftop opening 110. The building (or inside) air is vented out from the interior airspace 106 through fans (for example, bathrooms fans) or escapes the interior airspace 106 through building leakage (i.e., through opened doors, opened windows, etc.). As illustrated in FIG. 1, the HVAC system 100 is in fluid communication with the interior airspace 106 of the building 105 and may be used to provided heated air (and/or cooled air to the interior airspace 106, as further described below). While the HVAC system 100 depicted in FIG. 1 is a rooftop system, any other suitable HVAC system 100 (including non-rooftop systems, as well as systems with different ducts/openings configurations) may be used in other embodiments.

It will be readily appreciated that the volume of the building air, as well as the pressure, in the interior airspace 106 of the building 105, is defined at least in part by the differential between the volumetric airflow rate of outside air being provided to the interior airspace 106 (or make-up air) and the volumetric airflow rate of building air being removed from the interior airspace 106 (or exhaust). For example, if the volumetric airflow rate of outside air being provided to the interior airspace 106 is greater than the volumetric airflow rate of building air being removed from the interior airspace 106, then the pressure in the interior airspace 106 is positive (or increases). Conversely, if the volumetric airflow rate of building air being removed from the interior airspace 106 is greater than the volumetric airflow rate of outside air being provided to the interior airspace 106, then the pressure in the interior airspace 106 is negative (or decreases). Other factors that may contribute to the pressure of the interior airspace 106 of the building 105 include the general air-tightness of the building 105 as well as the presence of external forces, such as but not limited to wind. Maintaining the pressure of the interior airspace 106 of the building 105 at a set pressure is generally referred to as maintaining the envelope of the building 105.

As described above, the pressure of the interior airspace 106 (or the building envelope) can be, depending on the conditions, either positive or negative. The building envelope is generally designed to be positive, which prevents outside air from naturally entering the building 105, as may be the case for example during the summer to keep the hot air outside (outside air can still, however, enter the building 105 via the HVAC system 100). A negative building envelope allows air to naturally enter the building 105 and is generally undesirable.

In one embodiment, with further reference to FIG. 2, the HVAC system 100 comprises a controller 200, a heat exchanger 202 and an air volume correction system 206, as further described below.

In this embodiment, the controller 200 is configurable to operate the HVAC system 100 and may be used to set and/or modify various operating parameters of the HVAC system 100, including regulating the operation of the heat exchanger 202. The HVAC system 100 may, for example, transmit or receive data related to one or more operating parameters to or from the controller 200 in analog or digital signals. For powering the controller 200, an electrical connection (not shown) is provided, as well as an optional auxiliary power source taking the form of a battery (not shown). In this embodiment, the controller 200 may be a control board or mainboard that is operable (by a user) to send control messages responsible for fan, burner and/or damper operations, as further described below. The controller 200 may be operatively connected to a thermostat of the building 105, or a standalone controller.

Figure 3:
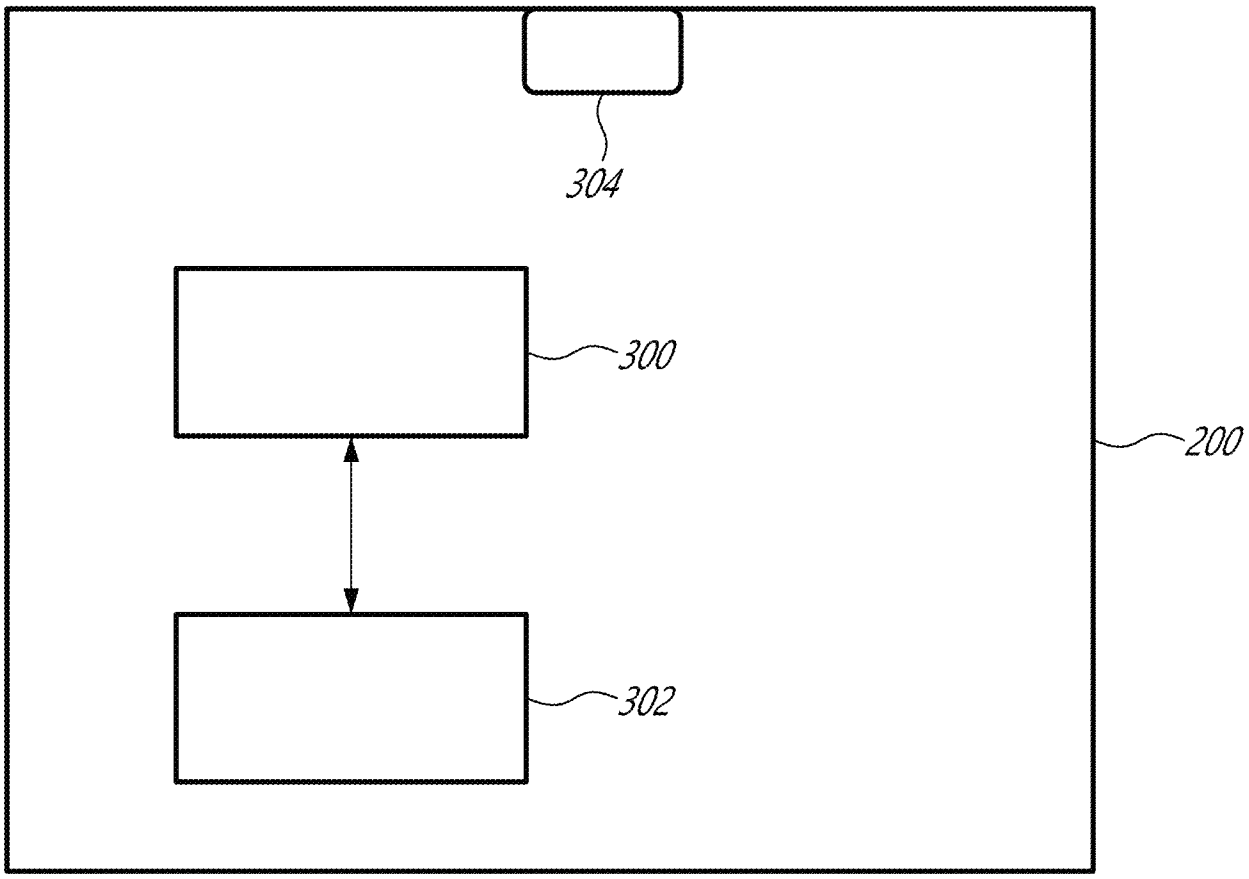
FIG. 3 is a schematic representation of the controller of FIG. 2, in accordance with one embodiment.

In one embodiment, and with further reference to FIG. 3, the controller 200 comprises a processing unit 300 and a non-transitory storage medium 302 operatively connected to the processing unit 300. The processing unit 300 includes a processing device or unit, such as, without limitation, an integrated circuit (IC), an application specific integrated circuit (ASIC), a microcomputer, a programmable logic controller (PLC), and/or any other programmable circuit. The processing unit 300 may include multiple processing units (e.g., in a multi-core configuration). The controller 200 is configurable to perform the operations described herein by programming the processing unit 300. For example, the processing unit 300 may be programmed by encoding an operation as one or more executable instructions and providing the executable instructions to the processing unit 300 in the storage medium 302 coupled to the processing unit 300. The non-transitory storage medium 302 includes, without limitation, one or more random access memory (RAM) devices, one or more storage devices, and/or one or more computer readable media. The non-transitory storage medium 302 is configured to store data, such as computer-executable instructions. The non-transitory storage medium 302 includes any device allowing instructions, such as executable instructions and/or other data, to be stored and retrieved. It will be appreciated that one or more of the components of the controller 200 described herein may be part of an integrated circuit.

In this embodiment, the controller 200 comprises at least one first communication interface 304 for allowing communication between the controller 200 and the HVAC system 100 via a first communication link 201, which may be a wireless or a wired communication link. The at least one first communication interface 304 may be connectable to at least a portion of the components of the HVAC system 100 such as, but not limited to, valves, motors, sensors, etc. For example, the controller 200 may be connected, via the first communication link 201, to several temperature sensors (not shown) positioned in distinct areas of the interior airspace 106 of the building 105. In another embodiment, the HVAC system 100 may have a communication interface (not shown) operatively connected to its components, and the at least one first communication interface 304 may be connected to the communication interface of the HVAC system 100.

Figure 2:
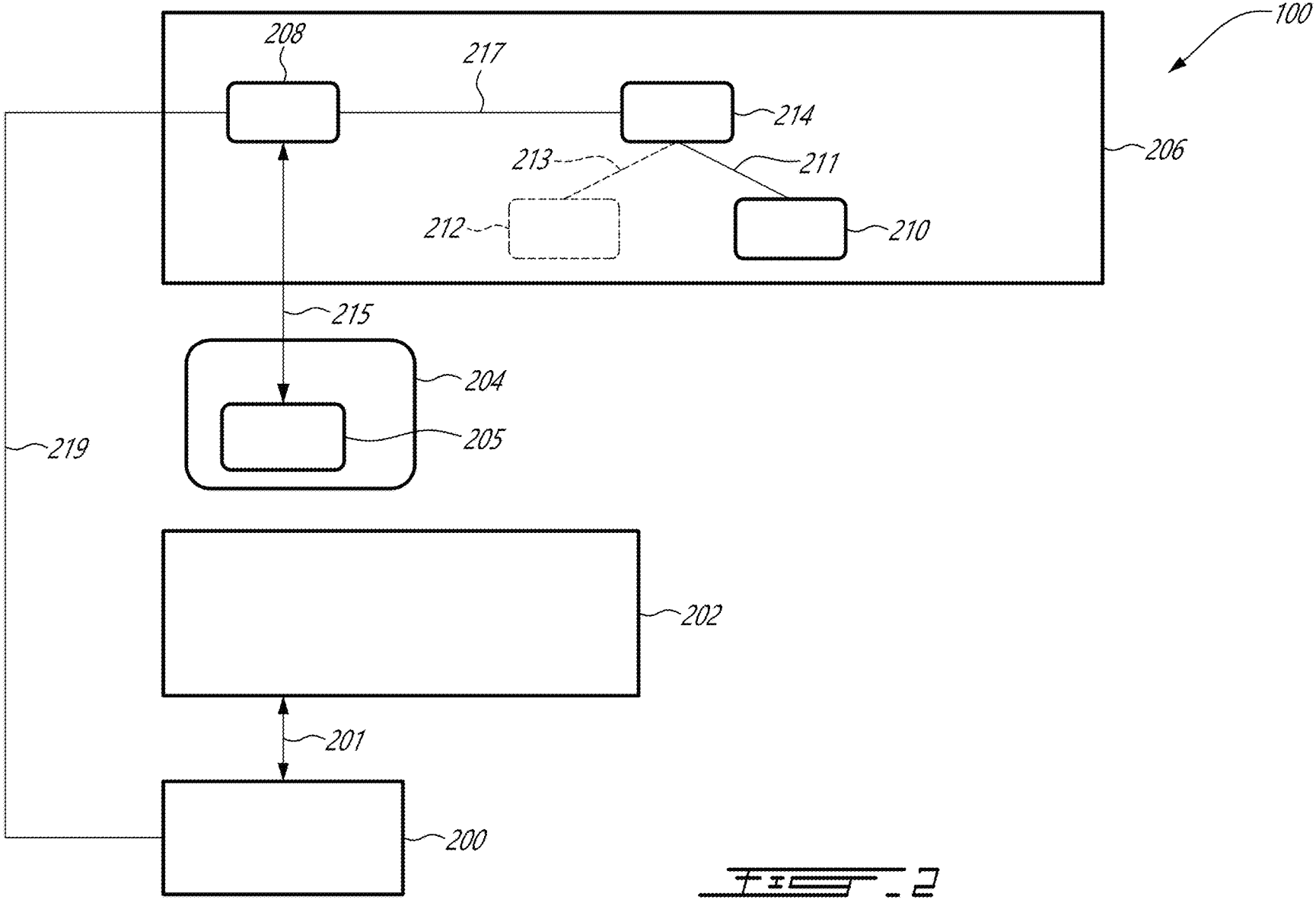
FIG. 2 is a schematic representation of the HVAC system of FIG. 1 and comprising a controller, a heat exchanger and an air volume correction system, in accordance with one embodiment.

In the embodiment illustrated in FIGS. 2 and 3, the first communication link 201 is a wired communication link and the at least one first communication interface 304 is a wired communication interface to communicate with the HVAC system 100 via the first communication link 201. In another embodiment (not shown), the at least one first communication interface 304 comprises a wireless communication interface such as one or more of: a radiofrequency (RF) interface, a Wi-Fi™ interface, a Bluetooth™ interface and the likes, and the first communication link 201 is a wireless communication link.

In this embodiment, the controller 200 is operatively connected, via the communication interface 304 and the communication link 201, to one or more components of the HVAC system 100, such as but not limited to the heat exchanger 202. In this context, the non-transitory storage medium 302 of the controller 200 may store computer executable instructions that direct the HVAC system 100, specifically the heat exchanger 200, to implement specific heating or cooling programs, schedules, diagnostics, and the likes. The controller 200 may, for example, provide control signals to the one or more components and/or receive signals from the one or more components of the HVAC system 100, including the heat exchanger 202. The HVAC system 100 may also communicate data related to one or more operating parameters of the HVAC system 100, either to the controller 200 or from the controller 200, in analog or digital signals, for example a temperature setpoint in the interior airspace 106 of the building 105 (i.e., the "desired" temperature of the interior airspace 106 as set by a user at the level of the controller 200 (expressed in degree Fahrenheit (° F.) or Celsius (° C.)) or a temperature of the interior airspace 106 (in ° F. or ° C.) as measured by a temperature sensor positioned in the interior airspace 106. For example, the temperature sensor may be positioned in either one of the building supply duct 107 or the building return duct (not shown).

In one embodiment, the controller 200 may also comprise at least one input/output interface (not shown) for coupling a plurality of components thereto. For example, the input/output interface may be coupled to a display (not shown) for presenting information to a user. Display is any component capable of conveying information to the user. Display includes, without limitation, a display device (not shown) (e.g., a liquid crystal display (LCD), organic light emitting diode (OLED) display, or display includes an output adapter (not shown), such as a video adapter and/or an audio adapter. Output adapter is operatively coupled to a processor (not shown) and configured to be operatively coupled to an output device (not shown), such as a display device or an audio output device.

In addition, the input/output interface may be operatively connected to an input device (not shown) for receiving input from the user. The input device includes, for example, a keyboard, a pointing device, a mouse, a stylus, a touch sensitive panel (e.g., a touch pad or a touch screen), a gyroscope, an accelerometer, a position detector, and/or an audio input device. A single component, such as a touch screen, may function as both an output device of display and input device. The user may, for example, program the controller 200 via the display and the input device to control different components of the HVAC system 100, as further described below. For example, the controller 200, specifically the input device of the controller 200, may be used by a user to set and/or modify the temperature setpoint of the interior airspace 106.

In a further embodiment, the controller 200 may also comprise a second communication interface (not shown) for allowing the controller 200 to communicate with a mobile device via a second communication link (not shown). The second communication interface may comprise a wireless communication interface such as one or more of: a radiofrequency (RF) interface, a Wi-Fi™ interface, a Bluetooth™ interface and the likes. When the at least one first communication interface 304 is a wireless communication interface, the second communication interface may be a wireless communication interface similar to the first communication interface 304 or may be a different type of wireless communication interface. The mobile device may comprise one or more of a laptop computer, a smartphone, a tablet, a personal digital assistant (PDA), and the likes. The mobile device is associated with a user such as an operator of the HVAC system 100, for example. The user may access different parameters of the controller 200 and the HVAC system 100 via the mobile device. It is contemplated that the mobile device may be coupled to the controller 200 via a communication network (not shown) such as the Internet, which enables the user to access information and/or control the controller 200 and the HVAC system 100.

In this embodiment, as described above the HVAC system 100 also comprises the heat exchanger 202, i.e., a device that can exchange heat, or thermal energy, between two fluids (i.e., a gas or a liquid) circulating in the heat exchanger 202, without the two fluids being in direct contact with each other (i.e., the two fluids do not mix as they circulate throughout the heat exchanger 202).

Heat exchangers used in HVAC systems such as the HVAC system 100 include a condenser typically comprising a set of tubes, fins, coils, plates, etc. made of a material that can absorb and conduct thermal energy, such as a metal, a composite, a ceramic, a polymer or any combination thereof. The condenser defines a first volume in which a first fluid circulates. A second fluid circulates in a second volume defined by a sealed compartment outside the condenser. In a non-limiting example, the outside air entering the interior airspace 106 of the building 105 circulates through the second volume, while a refrigerant circulates through the first volume. When the temperature of the refrigerant circulating through the first volume is different from the temperature of the outside air circulating through the second volume, heat (or thermal energy) is transferred between the refrigerant and the outside air through the condenser, as further described below.

For example, if the outside air going through the heat exchanger 202 is cooler than the refrigerant, then heat, or thermal energy, is transferred from the refrigerant to the outside air, resulting in an increase of the temperature of the outside air going through the heat exchanger 202. Conversely, if the outside air going through the heat exchanger 202 is warmer than the refrigerant, then heat, or thermal energy, is transferred from the outside air to the refrigerant, resulting in a decrease of the temperature of the outside air going through the heat exchanger 202. In other words, the heat exchanger 202 can readily be used in heating or cooling processes to heat or cool the outside air entering the heat exchanger 202, and accordingly to heat or cool the interior airspace 106 of the building 105.

The refrigerant may be a gas (in which case the heat exchanger 202 is referred to as a gas-to-gas heat exchanger) or a liquid (in which case the heat exchanger 202 is referred to as a liquid-to-gas heat exchanger). In some non-limiting examples, the refrigerant may be R-22 (Freon®), R-410A (Puron®), R-407C (Suva®), R-134a, R-32, R-454B or any other suitable refrigerant.

The heat exchanger 202 includes an intake region which corresponds to a region where the outside air enters the heat exchanger 202 and a discharge region which corresponds to a region where air is released from the heat exchanger 202 into the interior airspace 106 of the building 105. Between the intake region and the discharge region, the outside air circulates through the second volume of the heat exchanger 202, as described above.

For the refrigerant to be at a temperature greater than the temperature of the outside air, the refrigerant may be heated (independently of any exchange of heat, or thermal energy, between the heat exchange fluid and the outside air) by a heating system of the heat exchanger 202 (not shown). In a non-limiting example, the heating system comprises a burner fed by a fuel and in which the firing rate of the burner (expressed in volume of fuel per unit of time or in rated maximum firing rate of the burner) as well as the manifold pressure of the burner (i.e., the fuel pressure in the manifold that feeds the fuel to the burner of the heat exchanger 202) may be controlled by the controller 200. The burner typically comprises one or more modulating gas valves feeding gas to the burner and controlling the amount of fuel that is being fed to the burner. Any other suitable heating system for the heat exchanger 202 may be used in other examples.

For the outside air to circulate through the heat exchanger 202, specifically through the second volume of the heat exchanger 202, the HVAC system 100 also includes a blower 204 (also referred to as HVAC system blower 204) having a blower motor 205. For example, the HVAC system blower 204 is a fan having a plurality of fan blades that are set in motion by the blower motor 205. In some non-limiting examples, the blower motor 205 can be a direct drive motor, a belt driven motor or any other suitable motor. For example, the blower motor 205 may be a single speed motor (i.e., the blower motor 205 may either operate at its maximum rated speed, typically expressed in rotations per minute or RPM, or be turned off). The blower motor 205 can be characterized by a power (e.g., horsepower) and it will be appreciated that the higher the power of the blower motor 205, the higher the RPM of the blower motor 205 and the higher the volumetric airflow rate through the HVAC system blower 204 when the HVAC system blower 204 is in operation. In some non-limiting examples, in the HVAC system 100 the volumetric airflow rate of outside air entering the interior airspace 106 of the building 105 through the heat exchanger 202 may be between about 100 CFM and about 1,000,000 CFM.

The heat exchanger 202 is a blow through heat exchanger, that is the HVAC system blower 204 is positioned before the condenser of the of the heat exchanger 202 along a direction of travel of air throughout (or around) the heat exchanger 202. In other words, the HVAC system blower 204 blows air "forward" in (or "towards") the heat exchanger 202. It will be appreciated that any suitable type of blow through heat exchanger may be used in the HVAC system 100, including but not limited to shell-and-tube heat exchangers (including U-tube and straight tube heat exchangers), plate heat exchangers, fin heat exchangers, plate-fin heat exchangers, drum heat exchangers, double pipe or hairpin heat exchangers, heat pump condensers, hydronic coils, modulation reheat and the likes.

HVAC systems, such as the HVAC system 100, which may be installed in commercial or residential buildings, are typically designed to achieve a target pressure in the interior airspace 106 of the building 105 (i.e., the building envelope). In this context, the HVAC system blower 204 (and, specifically, the blower motor 205 of the HVAC system blower 204) of the heat exchanger 202 is selected (for example, in terms of the horsepower of the blower motor 205) to achieve a target and generally constant volumetric airflow rate of outside air that enters the building 105 (when the HVAC system blower 204 is in operation). In other words, and taking into account that the volumetric airflow rate of building air that is released from the building 105 can be considered as generally constant, the horsepower of the blower motor 205 is selected to achieve a target pressure in the interior airspace 106 of the building 105. Blowers, such as the HVAC system blower 204, are constant volume devices, that is the HVAC system blower 204 is either on or off (and, accordingly, receives only on or off messages from the controller 200) and can only produce a fixed volumetric airflow rate to achieve the target pressure in the interior airspace 106 of the building 105. When the HVAC system 100 is in operation, the HVAC system blower 204 is always on and the HVAC system 100 is designed to operate at a set volumetric airflow rate of outside air that enters the building 105 (or a set volume of air in the interior airspace 106 of the building 105, which are referred to as the design airflow rate and the design volume, respectively) to achieve the target pressure inside the building 105. The HVAC system 100 is also designed to operate at a set volumetric airflow rate of outside air that enters the building 105 at a given static pressure to achieve the temperature setpoint of the interior airspace 106 the building 105—this is referred to as the "design specifications" of the HVAC system 100.

It will also be appreciated that parameters such as the firing rate of the burner (and the manifold pressure of the burner), as well as the electrical consumption of the components of the HVAC system 100 such as the HVAC system blower 204, are directly correlated to the energy consumption of the HVAC system 100. For example, an increase in the firing rate of the burner (when the outside air is cold and requires heating to meet the temperature setpoint of the interior airspace 106) means that the energy consumption of the HVAC system 100 increases. The burner of the HVAC system 100 is fed with natural gas, and the costs of operating the HVAC system 100 can be correlated, at least in part, with: (i) a consumption of electricity by the HVAC system 100 (for example, to operate the HVAC system blower 204, etc.); and (ii) a consumption of natural gas by the HVAC system 100, specifically with a consumption of natural gas by the burner of the heat exchanger 202. Generally, the higher the energy consumption of the HVAC system 100, the higher the operating costs associated with the consumption of electricity and natural gas by the HVAC system 100. Conversely, the lower the energy consumption of the HVAC system 100, the lower the operating costs associated with the consumption of electricity and natural gas by the HVAC system 100.

The energy consumption of the heat exchanger 202, as well as the heat consumption of the HVAC system 100 generally, is in turn directly correlated with the emission of green house gas (or GHG) from the building 105. Some countries, such as Canada, have implemented a price per ton of carbon dioxide equivalent (CO2e) emissions for systems such as the HVAC system 100 (also referred to as carbon price or carbon tax, expressed in dollar per gigajoule ($/GJ) of energy consumed by the HVAC system 100). It is generally accepted that systems such as the HVAC system 100 typically generate about 50 kg of $CO_2$ for each GJ of energy consumed by the HVAC system 100.

The controller 200 may execute computer-executable instructions stored in the non-transitory storage medium 302 of the controller 200 that direct the controller 200 to send control signals via the first communication interface 304 and the first communication link 201 to one or more components of the HVAC system 100. For example, the controller 200 can send control messages to the heat exchanger 202 to set and/or modify:

- A firing rate of the burner of the heat exchanger 202, for example in accordance with the temperature setpoint of the interior airspace 106. In practice, the firing rate of the burner is modulated via the one or more firing valves that regulate the flow of the fuel to the burner. It will be appreciated that the burner of the heat exchanger 202 can be operated anywhere between 0% firing rate (i.e., the burner is off) and 100% firing rate (i.e., the burner operates at maximum capacity). While the controller 200 does not directly set the manifold pressure of the burner of the heat exchanger 202, the manifold pressure is correlated to the firing rate of the burner (i.e., the higher the firing rate of the burner, the higher the manifold pressure of the burner). There is also a correlation between the firing rate of the burner and the discharge air temperature of the heat exchanger 202 (i.e., the higher the firing rate of the burner, the higher the discharge air temperature). The manifold pressure of the burner (i.e., the pressure of the fuel inside the manifold feeding the fuel to the burner) is also controlled by the controller 200, albeit indirectly, as it varies with the position of the one or more valves that regulate the flow of the fuel to the burner.
- An on/off state of the blower motor 205 of the HVAC system 100. In this embodiment, the controller 200 is operatively coupled to the blower motor 205 via: (i) a communication link 219 between the controller 200 and a fan speed controller 208 (which is part of an air volume correction system 206, as further described below); and (ii) a communication link 215 between the fan speed controller 208 and the blower motor 205. It will be appreciated that, in this embodiment, the controller 200 sends on/off (or start/stop) signals to the blower motor 205 via the first communication interface 304, although the on/off signals could be communicated to the blower motor 205 via a distinct communication interface of the controller 200 (not shown) in other embodiments. In yet further embodiments (not shown), the controller 200 may be operatively coupled directly to the blower motor 205 of the HVAC system 100 via a communication link between the controller 200 and the blower motor 205 (i.e., there is no fan speed controller in these embodiments).

The air volume correction system 206 comprises a volume correction controller 214 operatively connected to an intake sensor 210 via a communication link 211 and to a fan speed controller 208 via a communication link 217. As described above, the fan speed controller 208 is also operatively coupled: (i) to the controller 200 via the communication link 219; and (ii) to the blower motor 205 of the heat exchanger 202 via the communication link 215. The volume correction controller 214 is powered via an electrical wired plug connectable to an electrical socket (not shown).

Figure 4:
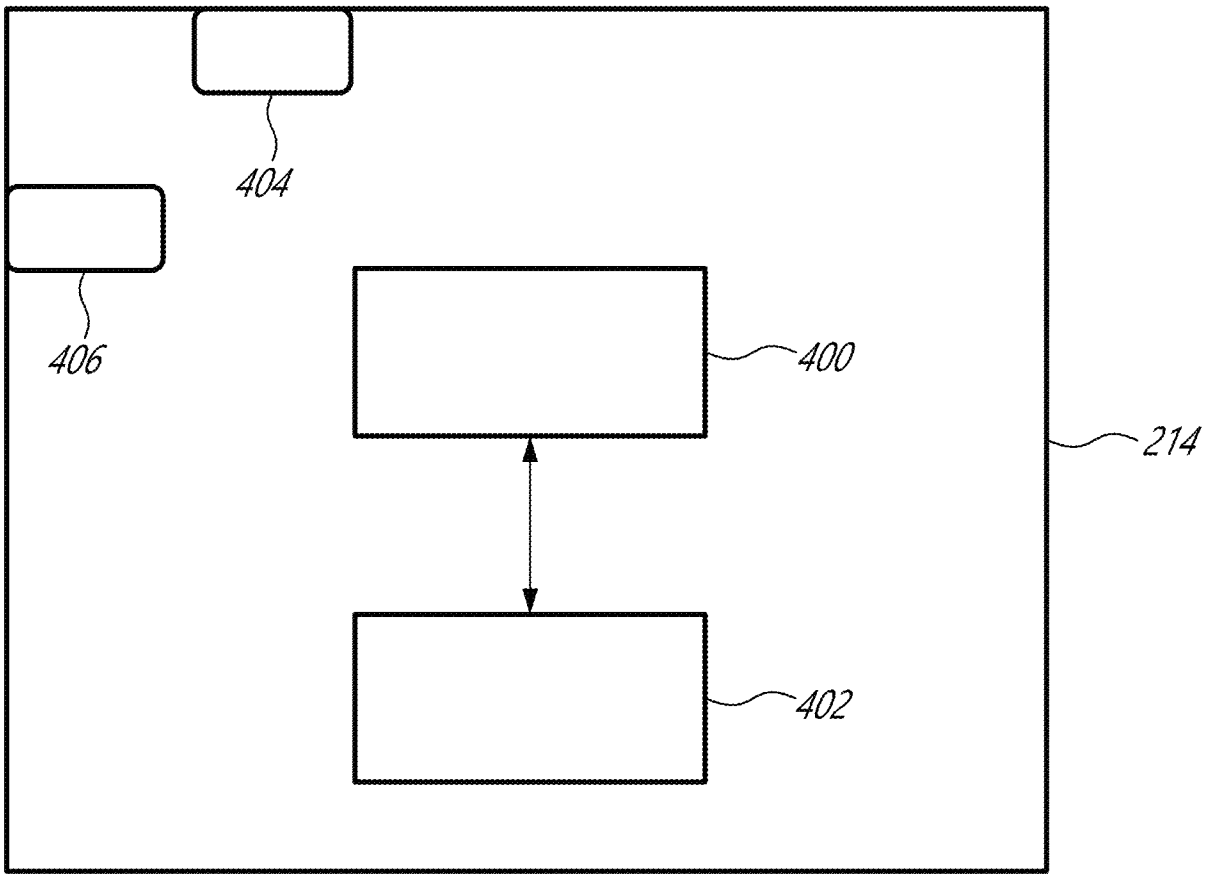
FIG. 4 is a schematic representation of a volume correction controller of the air volume correction system of FIG. 2, in accordance with one embodiment.

With further reference to FIG. 4, in this embodiment, the volume correction controller 214 of the air volume correction system 206 comprises a processing unit 400 and a non-transitory storage medium 402 operatively connected to the processing unit 400. The processing unit 400 includes a processing device or unit, such as, without limitation, an IC, an ASIC, a microcomputer, a PLC, and/or any other programmable circuit. The processing unit 400 may include multiple processing units (e.g., in a multi-core configuration). The volume correction controller 214 is configurable to perform the operations described herein by the programming processing unit 400. For example, the processing unit 400 may be programmed by encoding an operation as one or more executable instructions and providing the executable instructions to the processing unit 400 in the storage medium 402 coupled to the processing unit 400. The non-transitory storage medium 402 includes, without limitation, one or more RAM devices, one or more storage devices, and/or one or more computer readable media. The non-transitory storage medium 402 is configured to store data, such as computer-executable instructions. The non-transitory storage medium 402 includes any device allowing instructions, such as executable instructions and/or other data, to be stored and retrieved. It will be appreciated that one or more of the components of the volume correction controller 214 described herein may be part of an integrated circuit.

Still in this embodiment, the intake sensor 210 of the air volume correction system 206 is a temperature sensor positioned in the intake region of the heat exchanger 202. The intake sensor 210 is configured to acquire air intake temperature information, that is a temperature of the air in the intake region of the heat exchanger 202. In some non-limiting examples, the temperature of the air in the intake region of the heat exchanger 202 may be a temperature of the outside air entering the heat exchanger 202 (expressed in degree Fahrenheit (° F.) or Celsius (° C.))—this is the case where the air in the intake region of the heat exchanger 202 is made up of 100% outside air. In other non-limiting examples, for example when the HVAC system 100 is configured to recirculate at least a portion of the building air towards the intake region of the heat exchanger 202, the temperature of the air in the intake region of the heat exchanger 202 may be different from the temperature of the outside air entering the heat exchanger 202. In these non-limiting examples, the HVAC system 100 may further comprise dampers operative to control a volumetric airflow of the building air being recirculated towards the intake region of the heat exchanger 202. In this case, only a portion of the air in the intake region of the heat exchanger 202 is made up of outside air. For example, assuming the outdoor air temperature is about −30° C., the building air is about 20° C. and that a portion of the building air is recirculated towards the intake region of the heat exchanger 202 where the mix between the outside air and the building air about 50/50 (in volume/volume), then the temperature of the air in the intake region of the heat exchanger 202 would be about −5° C.

The time interval between the acquisition of the air intake temperature information (also referred to as sampling rate) may be 60 seconds, in some cases 30 seconds, in some cases 20 seconds, in some cases 10 seconds, in some cases 5 seconds, in some cases 1 second, in some cases 0.1 second and in some cases even less. It will be appreciated that any other suitable time interval may be used in other examples, or that the intake sensor 210 may continuously acquire the air intake temperature information. The volume correction controller 214 is configured to obtain the air intake temperature information acquired by the intake sensor (via the communication link 211) and store the air intake temperature information in the non-transitory storage medium 402.

The volume correction controller 214 comprises a first communication interface 404 for allowing communication between the volume correction controller 214 and the intake sensor 210 via a first communication link 211. The first communication interface 404 may be a wired communication interface or a wireless communication interface such as one or more of: a radiofrequency (RF) interface, a Wi-Fi™ interface, a Bluetooth™ interface and the likes. The first communication link 211 may accordingly be a wireless communication link or a wired communication link. As described above, in this embodiment the volume correction controller 214 is operatively connected to the heat exchanger 202, specifically to the HVAC system blower 204 of the heat exchanger 202, through the fan speed controller 208. In this context, the volume correction controller 214 also comprises a second communication interface 406 for allowing communication between the volume correction controller 214 and the fan speed controller 208 via a communication link 217 (the volume correction controller 214 being operative to communicate a signal representative of a speed of the blower motor 205 via the communication link 217 using any suitable communication protocol), the fan speed controller 208 being operatively coupled to the blower motor 205 of the HVAC system blower 204 via a communication link 215. In some non-limiting examples, the communication link 217 is a wired communication link.

The fan speed controller 208 is a device that can control the speed and/or torque of an electric motor, such as the blower motor 205. In one non-limiting example, the fan speed controller 208 is a variable frequency drive (VFD) which controls the speed of the blower motor 205 by modulating the frequency of the electric current that is sent by the VFD to the blower motor 205. In other words, the VFD enables the blower motor 205 to operate at a speed (in RPM) that is below its maximum operating speed, even though the blower motor 205 is a single speed motor. The VFD can also increase or decrease the speed of the blower motor 205 as the operational requirements of the HVAC system 100 change, and as instructed by the volume correction controller 214. In some non-limiting examples, the VFD is powered by a three-phase alternating current (AC) at a frequency of 60 Hz (as typically found in the United States and Canada), however any other suitable frequency may be used in other non-limiting examples. The VFD converts the AC current into direct current (DC) through a rectifier circuit and then sends the DC current to a DC bus to filter the voltage. The DC current is then sent to an inverter which creates pulses of DC current that function like AC current. The higher the DC pulse frequency (which is also referred to generally as VFD speed), the higher the speed of the blower motor 205. The lower the DC pulse frequency, the lower the speed of the blower motor 205. It will be appreciated that any other suitable device capable of controlling the speed and/or torque of the blower motor 205 may be used as the fan speed controller 208 (such as, but not limited to, by using an electronically commutated motor as the blower motor 205). In other embodiments (not shown), the blower motor 205 may be an electronically commutated motor, which integrates a fan speed control function—it will be appreciated that the fan speed controller 208 may be omitted in this configuration and the volume correction controller 214 may be operatively coupled directly with the commutated motor of the HVAC system blower 204 to modulate the speed of the commutated motor of the HVAC system blower 204.

The blower motor 205 is operatively connected to the controller 200 via: (i) the communication link 219 between the controller 200 and the fan speed controller 208; and (ii) the communication link 215 between the fan speed controller 208 and the blower motor 205. For example, on/off control signals are sent by the controller 200 to the fan speed controller 208. The fan speed controller 208 can also modulate the speed of the blower motor 205 in accordance with instructions communicated by the volume correction controller 214, specifically in response to the communication of a signal representative of a speed of the blower motor 205 by the volume correction controller 214 via the communication link 217, as further described below.

The fan speed controller 208 is also operatively coupled to the volume correction controller 214 via the communication link 217. Using the data acquired at least by the intake sensor 210 (i.e., using the air intake temperature information), the volume correction controller 214 is configured to modify the speed of the blower motor 205 of the heat exchanger 202, via the fan speed controller 208 in this embodiment, to account for the thermal expansion (or contraction) of air through the heat exchanger 202. In this context, the non-transitory storage medium 402 of the volume correction controller 214 stores computer-executable instructions that direct the volume correction controller 214 to calculate a modified blower motor speed in accordance with equations 1, 2 and 3 below (the symbol*represents multiplication):

$$\text{modified blower motor speed}=(1-\text{volume correction factor})*100 \qquad \text{equation 1}$$

$$\text{volume correction factor}=\text{temperature differential}*\text{thermal expansion coefficient} \qquad \text{equation 2}$$

$$\text{temperature differential}=\text{air discharge temperature}-\text{air intake temperature} \qquad \text{equation 3}$$

With reference to equation 3, the temperature differential (expressed in ° F. or ° C.) corresponds to the difference in temperature between the air discharge temperature (or a temperature of the air in the discharge region of the heat exchanger 202) and the air intake temperature (as described above, the air intake temperature corresponds to the temperature of the air in the intake region of the heat exchanger 202 and may or may not be equal to the outside air temperature–the intake air may be made of 100% outside air or, when the HVAC system 100 is configured to recirculate at least a portion of the air exiting the heat exchanger 202 back towards the intake region of the heat exchanger 202, the intake air may be made of any suitable proportion of outside air/recirculated air) and may be calculated by the volume correction controller 214 in a number of ways, as further described below.

In one embodiment, the air intake temperature in equation 3 is a variable (as it is acquired by the intake sensor 210) and the air discharge temperature is a constant. For example, the air discharge temperature may be the temperature setpoint of the interior airspace 106 of the building 105 (e.g., 20° C. or 68° F.). The numerical value of the air discharge temperature can be set directly at the level of the volume correction controller 214 and stored in the non-transitory storage medium 402 of the volume correction controller 214. In other embodiments, the volume correction controller 214 is operatively connected to the controller 200, which is operatively connected to the thermostat of the building 105, and the controller 200 is further configured to obtain from the thermostat the temperature setpoint of the interior airspace 106 of the building 105 (for example, as set by a user at the level of the thermostat).

In another embodiment, the air intake temperature in equation 3 is a variable (as it is acquired by the intake sensor 210) and the air discharge temperature is also a variable. In this non-limiting embodiment, the air volume correction system 206 also comprises a discharge sensor 212 positioned in the discharge region of the heat exchanger 202 (shown in FIG. 2). The first communication interface 404 of the volume correction controller 214 also enables communication between the volume correction controller 214 and the discharge sensor 212 via a second communication link 213. The second communication link 213 may be a wireless communication link or a wired communication link. The discharge sensor 212 is configured to acquire air discharge temperature information, that is a temperature of the air in the discharge region of the heat exchanger 202, or a temperature of the air being discharged from the heat exchanger 202 into the interior space 106 of the building 105 (expressed in ° C. or ° F.). The volume correction controller 214 is configured to obtain the air discharge temperature information acquired by the discharge sensor (via the communication link 213) and store the air discharge temperature information acquired in the non-transitory storage medium 402. The time interval between the acquisition of the air discharge temperature information (also referred to as sampling rate) may be 60 seconds, in some cases 30 seconds, in some cases 20 seconds, in some cases 10 seconds, in some cases 5 seconds, in some cases 1 second, in some cases 0.1 second and in some cases even less. It will be appreciated that any other suitable time interval may be used in other examples, or that the discharge sensor 212 may continuously acquire the air discharge temperature information. It will be appreciated that using the air discharge temperature acquired by the discharge sensor 212 enables a more accurate and fine-tuned determination of the temperature differential by the volume correction controller 214.

The non-transitory storage medium 402 of the volume correction controller 214 also stores a thermal expansion coefficient (expressed in /° F. or /° C.) which characterizes the increase in volume of a cubic meter ($m^3$) of air by raising the temperature of the cubic meter of air by 1° C. (or 1° F.). The thermal expansion coefficient is used by the volume correction controller 214 in equation 2 above to calculate a volume correction factor to dynamically account for the thermal expansion of air through the heat exchanger 202, taking into account the calculated temperature differential. While the expression "thermal expansion" has been used throughout the present disclosure, it will be appreciated that depending on whether the calculated temperature differential is a positive or negative number, the volume correction controller 214 can account for both thermal expansion of air (which occurs when the air temperature increases in the HVAC system 100) and thermal contraction of air (which occurs when the air temperature decreases in the HVAC system 100).

It will be appreciated that the thermal expansion coefficient of air varies with temperature and pressure. For example, the thermal expansion coefficient of air at 20° C. and 1 atm is 0.00225/° F. As further described below, the computation of the volume correction factor in equation 2 assumes that air is at standard conditions of pressure (i.e., 1 atm) such that pressure can be ignored when assessing a suitable thermal expansion coefficient. In a non-limiting example, the volume correction controller 214 may store in the non-transitory storage medium 402 a database of thermal expansion coefficients of air at various temperatures (and at a pressure of 1 atm) and/or humidity and environmental conditions and the volume correction controller 214 may select the suitable thermal expansion coefficient based on the intake air temperature and/or the temperature setpoint for the interior airspace 106 of the building 105. Given that the thermal expansion coefficient of air increases with the temperature differential, greater temperature differentials will result in greater volume correction factors.

In order to prevent "over delivering", the HVAC system 100, specifically the volume correction controller 214, is configured to compute a modified blower motor speed in accordance with equation 1, taking into account the volume correction factor calculated in equation 2 as well as the air intake temperature that is acquired by the intake sensor 210, and the air discharge temperature that is also acquired by the discharge sensor 212, in an embodiment. The modified blower motor speed is expressed, for example, in percentage of the maximum operating blower motor speed (or "rated blower motor speed"—i.e., anywhere between 0 and 100% of the maximum operating blower motor speed).

Using the modified blower motor speed calculated in equation 3, the volume correction controller 214 sends control messages to the fan speed controller 208 via the communication link 217. In the non-limiting example in which the fan speed controller 208 is a VFD, the volume correction controller 214 sends control messages to the VFD to instruct the VFD to adjust the DC pulse frequency outputted by the VFD in accordance with the calculated modified blower motor speed. For example, if the calculated modified blower motor speed is 90% of the maximum operating blower motor speed, the VFD is instructed by the volume correction controller 214 to lower the DC pulse frequency (which is also referred to generally as VFD speed) outputted by the VFD to 90% of the maximum DC pulse frequency. This reduction of the DC pulse frequency being fed to the blower motor 205 via the communication link 215 results in a decrease of the operating blower motor speed from 100% to 90% of the maximum operating blower motor speed. As a result of the reduction of the blower motor speed, the volumetric airflow rate of the outside air entering the heat exchanger 202 (and, accordingly, the volume of outside air that enters the building 105 during a unit of time) is also reduced, taking into account the thermal expansion of air going through the heat exchanger 202.

As further discussed below, this translates into energy savings at the level of the HVAC system 100, as (when the HVAC system 100 is in heating mode): (i) a smaller volume of air is introduced in the interior airspace 106 of the building 105, the blower motor 205 being operated at a reduced blower motor speed; and (ii) a smaller volume of air is heated by the heat exchanger 202. Also, reducing the volume of air introduced in the interior airspace 106 of the building 105 enables the HVAC system 100 to achieve the design airflow rate and/or the design volume of the HVAC system 100 for the building 105.

Figure 5:
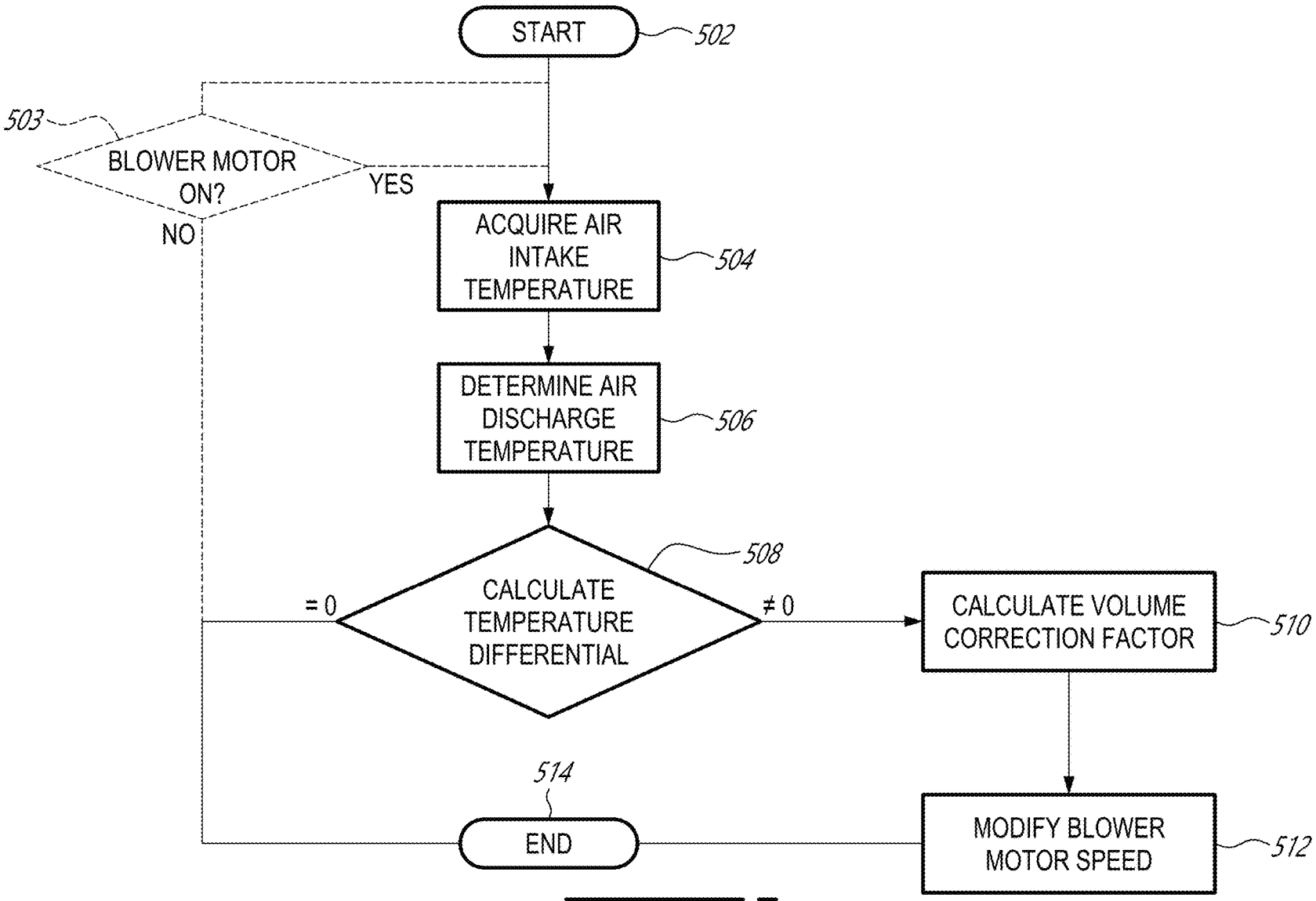
FIG. 5 is a flow chart of a process for reducing the energy consumption of the HVAC system of FIG. 1 in accordance with one embodiment.

With further reference to FIG. 5, the operation of the volume correction controller 214 will now be described. FIG. 5 shows a flowchart of a process 500, which is performed by the volume correction controller 214, for dynamically modulating the volume of outside air intake in the HVAC system 100, in accordance with an embodiment.

The process 500 is initiated by a start sequence 502, which is repeated at a prescribed time interval up to the end sequence 514 of the process. For example, the time interval between successive start sequences 502 may be 60 seconds, in some cases 30 seconds, in some cases 20 seconds, in some cases 10 seconds, in some cases 5 seconds, in some cases 1 second, in some cases 0.1 second and in some cases even less. In other non-limiting examples, the volume correction controller 214 may enter a standby mode upon receiving a standby start message (not shown)—in standby mode, the volume process controller 214 does not initiate the process 500 upon receiving the start sequence 502. The volume correction controller 214 may exit the standby mode upon receiving a standby end message (also not shown), after which the process 500 may be initiated by the start sequence 502 at the time interval described above. It will be appreciated that any other suitable time interval may be used in other examples, notably to ensure that the volume correction controller 214 does not fail to capture a temperature differential.

At a first (and optional) step 503, the volume correction controller 214 determines whether the blower motor 205 of the heat exchanger 202 is on (i.e., whether the last control message sent by the controller 200 and received by the heat exchanger 202 was an "on" message) or off (i.e., whether the last control message sent by the controller 200 and received by the heat exchanger 202 was an "off" message). If the blower motor 205 is off, the process 500 terminates at step 514. If the blower motor is on, the process 500 then proceeds to step 504.

At step 504, the volume correction controller 214 acquires the air intake temperature. Specifically, the volume correction controller 214 accesses the air intake temperature information stored in the non-transitory storage medium 402 of the volume correction controller 214–the air intake temperature is determined in real-time by the HVAC system 100 as it is acquired by the intake sensor 210. As described above, the air intake temperature may or may not be equal to the outside air temperature–the intake air may be made of 100% outside air or, when the HVAC system 100 is configured to recirculate at least a portion of the air exiting the heat exchanger 202 towards the intake region of the heat exchanger 202, the intake air may be made of any suitable proportion of outside air/recirculated air. In a subsequent step 506, the volume correction controller 214 determines the air discharge temperature. As described above, this can be done in a number of ways. For example, the correction controller 214 may use a numerical value stored in the non-transitory storage medium 402 and the numerical value may be, for example, set at 20° C. or 69° F. (which corresponds to the temperature at which HVAC systems, such as the HVAC system 100, are typically air balanced). In other non-limiting examples, the air discharge temperature may be determined in real-time by the HVAC system 100 (i.e., it is acquired by the discharge sensor 212) and the volume correction controller 214 may access the air discharge temperature information stored in the non-transitory storage medium 402 when the discharge sensor 212 is used. It will be appreciated that step 506 may be performed before step 504, or that steps 504 and 506 may be performed concurrently by the volume correction controller 214 in other embodiments.

At step 508, using the information acquired/determined by the volume correction controller 214 at steps 504 and 506, the volume correction controller 214 calculates a temperature differential, i.e. the difference between the air discharge temperature and the air intake temperature, in accordance with equation 3 above. If the temperature differential is null, the process 500 terminates at step 514 and the volume correction controller 214 instructs the blower motor 205 to operate the blower motor 205 at 100% of its rated power. In other words, the volume correction controller 214 does not perform any volume correction for the thermal expansion of air in the heat exchanger 202 when the air intake temperature and the air discharge temperature are identical.

If the temperature differential is not null, then at step 510 the volume correction controller 214 calculates a volume correction factor, in accordance with equation 2 above, to account for the thermal expansion of air through the heat exchanger 202. The calculation of the volume correction factor uses the thermal expansion coefficient stored in the non-transitory storage medium 402 of the volume correction controller 214.

At step 512, the volume correction controller 214 modifies the speed of the blower motor 205 in accordance with equation 1 above, taking into account the volume correction factor calculated at step 510. For example, the volume correction controller 214 sends control messages to the fan speed controller 208 (for example, a VFD) via the communication link 217, the fan speed controller 208 in turn sending control messages to the blower motor 205 via the communication link 215 (for example, reducing the DC pulse frequency outputted by the VFD), thereby modulating the speed of the blower motor 205 (for example, decreasing the speed of the blower 205).

In another embodiment (not shown), the non-transitory storage medium 402 of the volume correction controller 214 stores computer-executable instructions that direct the volume correction controller 214 to implement a dead band in which the process 500 is also terminated at step 508 if the calculated temperature differential is within the dead band. The dead band corresponds to a range of temperature differentials in which the implementation of the process 500 does not yield energy savings. For example, when the temperature differential is within the deadband, the firing of the burner of the heat exchanger 202 may result in an increase of the air intake temperature to a temperature that is beyond the temperature setpoint of the interior airspace 106 of the building 105, even though the firing rate of the burner is set to the minimum firing rate. In this situation, the burner will turn off as the temperature setpoint has been exceeded and the burner will continue cycling through on and off states, repeatedly exceeding the temperature setpoint of the interior airspace 106 of the building 105 and yielding no energy savings. By implementing a deadband in the process 500, the volume correction controller 204 avoids the possible on and off cycling of the burner of the heat exchanger 202.

The dead band may be defined in a number of ways. For example, the dead band may be defined, in some non-limiting examples, as a pre-determined range of temperature differential (e.g., 1° C., 2° C., 3° C., 4° C., etc.) which is calculated according to equation 3 above. If the temperature differential calculated at step 508 is not greater than the dead band, then the process 500 terminates at step 514. If the temperature differential calculated at step 508 is greater than the dead band, then the process 500 proceeds to step 510 and then to step 512 as described above. It will be appreciated that the size of the dead band may vary according to the configuration of the HVAC system 100 and that the size of the dead band may be continuously determined and/or refined over time, for a given configuration of the HVAC system 100, as the process 500 is performed by the air volume correction system 206 and energy savings levels can be determined for various temperature differentials.

The process 500 may be performed by the volume correction controller 214 for as long as "on" control messages are sent by the controller 200 to the fan speed controller 208 and the process 500 can be terminated at any time by the communication of an "off" control message from the controller 200 to the fan speed controller 208 (not shown).

As a result of the performance of the process 500, the HVAC system 100 may achieve various energy savings, while being able to achieve the temperature setpoint of the building 105 and/or design airflow rate and/or the design volume and/or the design specifications of the HVAC system 100. For example, by operating the blower motor 205 at a reduced blower motor speed, the electrical consumption of the HVAC system 100 is decreased. In other words, as the horsepower requirements of the blower motor 205 are decreased by operating the blower motor 205 at a reduced blower motor speed, the electrical consumption of the HVAC system 100 is also decreased. In some non-limiting examples, implementing the process 500 in the HVAC system 100 may result a decrease in the volumetric airflow rate (specifically, the blower motor speed) of at least 1%, in some cases at least 2%, in some cases at least 3%, in some cases at least 4%, in some cases at least 5%, in some cases at least 6%, in some cases at least 7% and in some cases even more, while being able to achieve the temperature setpoint of the building 105 and/or the design airflow rate and/or the design volume and/or the design specifications of the HVAC system 100.

By decreasing the amount of outside air being heated by the heat exchanger 202 of the HVAC system 100, the consumption of natural gas by the HVAC system 100 is also decreased.

This decrease in the consumption of natural gas by the HVAC system 100 may be estimated in a number of ways, including a decrease in the average firing rate of the burner of the heat exchanger 202 (measured over a prescribed period of time). In some non-limiting examples, implementing the process 500 in the HVAC system 100 may result in a decrease in the average firing rate of the burner of the heat exchanger 202 of at least 1%, in some cases at least 2%, in some cases at least 3%, in some cases at least 4%, in some cases at least 5%, in some cases at least 6%, in some cases at least 7%, in some cases at least 8%, in some cases at least 9%, in some cases at least 10%, in some cases at least 11%, in some cases at least 12%, in some cases at least 13%, in some cases at least 14%, in some cases at least 15%, in some cases at least 20%, in some cases at least 25%, in some cases at least 30%, in some cases at least 35% and in some cases even more, while being able to achieve the temperature setpoint of the building 105 and/or the design airflow rate and/or the design volume and/or the design specifications of the HVAC system 100.

Alternatively, the decrease in the consumption of natural gas by the HVAC system 100 may also be estimated by a decrease in the energy consumption of the HVAC system 100 (expressed in British thermal units—BTU—or in gigajoules—GJ—, which are representative of the amount of heat energy spent by the HVAC system 100 to heat the outside air entering the interior airspace 106 of the building 105). In some non-limiting examples, implementing the process 500 in the HVAC system 100 may result in a decrease in the energy consumption of the HVAC system 100 (expressed as a decrease in BTUs or GJs) of at least 2.5.%, in some cases at least 5%, in some cases at least 10%, in some cases at least 15%, in some cases at least 20%, in some cases at least 25%, in some cases at least 30%, in some cases at least 35% and in some cases even more, while being able to achieve the temperature setpoint of the building 105 and/or the design airflow rate and/or the design volume and/or the design specifications of the HVAC system 100.

It will be readily appreciated that such decrease in the consumption of natural gas by the HVAC system 100 will directly translate into costs savings for the operator of the HVAC system 100. Such costs savings may be estimated at least using the price per BTU or the price per GJ of natural gas (i.e., direct costs savings), and the carbon price or carbon tax (i.e., indirect costs savings, as a result of the decreased emissions of GHG from the HVAC system 100).

In some non-limiting examples, implementing the process 500 in the HVAC system 100 may result in a decrease in the production of GHG by the HVAC system 100 (expressed as a decrease in CO2e) of at least 2.5.%, in some cases at least 5%, in some cases at least 10%, in some cases at least 15%, in some cases at least 20%, in some cases at least 25%, in some cases at least 30%, in some cases at least 35% and in some cases even more, while being able to achieve the temperature setpoint of the building 105 and/or the design airflow rate and/or the design volume and/or the design specifications of the HVAC system 100.

By achieving the design specifications of the HVAC system 100, and generally maintaining the design volume of air in the interior airspace 106 of the building 105, any stack effect within the building 105 (i.e., the movement of air into and outside the building 105 through unsealed openings, chimneys, or other designed openings can be reduced and/or minimized and/or prevented as implementing the process 500 in the HVAC system 100 may result in maintaining a design pressure within the building 105. In some non-limiting examples, reducing and/or minimizing and/or preventing the stack effect within the building 105 may prevent the movement or introduction of undesirable gas (such as carbon monoxide CO) from one unit of the building to another unit of the building (for example, CO from a parking of the building 105 into an entrance or into residential units of the building 105, etc.). Also, reducing and/or minimizing and/or preventing the stack effect may also enable the HVAC system 100 to continue to operate in situations where the HVAC system 100 would not have a sufficient burner capacity to heat all the air introduced in the interior airspace 106 of the building 105 after thermal expansion, for example on very cold days. This may in turn, for example, prevent freezing of circulating water in water pipes of the building 105.

In one embodiment, the air volume correction system 206 may be provided as part of a retrofit module comprising a housing, the volume correction controller 214 and the VFD 208 being mounted inside the housing. The retrofit module can be used to control any existing HVAC system, in any type of residential, commercial or industrial building, and in which at least one blow through heat exchanger is used. The housing has the general shape of a box, however it will be appreciated that other shapes are possible, and the housing is preferably made of a liquid-proof material. The retrofit module could also be fitted into an existing cabinet for the controller 200. The retrofit module may be positioned in the vicinity of the HVAC system blower 204, for example on the roof of the building 105 if the HVAC system 100 is a rooftop unit, however the retrofit module may also be positioned in any other suitable location in other embodiments.

In another embodiment, the volume correction controller 214 may also be integrated with the heat exchanger 202. It will be appreciated that the heat exchanger 202 with the integrated volume correction controller 214 can be used when installing new HVAC systems in any type of residential, commercial or industrial building under construction, or when substituting or replacing existing HVAC systems in any type of residential, commercial or industrial building.

Example 1

Data pertaining to the air intake temperature (in ° C.), air discharge temperature (in ° C.), VFD speed (in rated % of maximum speed), burner firing rate (in rated % of maximum burner firing rate) and burner manifold pressure (in water column pressure or WC) was acquired in a HVAC system in which the air volume correction system was securely installed. The HVAC system was installed in a residential, four-story walkup building at a sampling rate of 1 second and with a hallway pressurization of 100% outside air. For a period of about 48 hours, "baseline" data was acquired on the HVAC system during which the process 500 was not implemented. During this period, the outdoor temperature (as measured via the air intake temperature) was between 6° C. and 13° C. and the temperature setpoint inside the building was set to 20° C. For a subsequent period of about 60 hours, "test" data was acquired on the HVAC system during which the process 500 was implemented. During this period, the outdoor temperature as measured via the air intake temperature was between 6° C. and 20° C. and the temperature setpoint inside the building was also set to 20° C. The thermal expansion coefficient used was 0.00225° $F.^{-1}$.

Average values of VFD speed, firing rate of the burner and manifold pressure of the burner were acquired, for the baseline data and the test data, and the results are shown in Table 1 below. The averages were made only using data acquired outside of a dead band of 3.5° C. (i.e., averages were not calculated for temperature differentials≤3.5° C.). It will be appreciated that, in Table 1 below, there is a 1:1 correspondence between the VFD speed and the speed of the motor of the blower of the HVAC system. The building design requirements (in terms of temperature) were met during the acquisition of the baseline data and the test data.

TABLE 1

| | VFD speed (%) | Firing rate (%) | Manifold pressure (WC) |
|---|---|---|---|
| Baseline data | 100 | 32.91 | 0.88 |
| Test data | 94.41 | 29.4 | 0.84 |
| Savings (%) | 5.59 | 10.66 | 4.54 |

As shown in Table 1, using the process 500, the HVAC system reduces the speed of the blower motor by 5.6% on average. As a result, the volumetric airflow rate entering the building was reduced compared to the baseline data, even though the building design requirements (in terms of temperature) were met. Similarly, using the process 500, the HVAC system reduces both the firing rate and the manifold pressure of the heat exchanger by about 10.66% and 4.54% on average, respectively.

Example 2

Data pertaining to the burner firing rate (in rated % of maximum burner firing rate) was acquired in a HVAC system in which the air volume correction system was securely installed. The HVAC system was installed in a residential building with 24 units and "baseline" data (i.e., data acquired when the process 500 was not implemented) and "test" data (i.e., data acquired when the process 500 was implemented)) were acquired. The thermal expansion coefficient used was 0.00225/° F.

Average values of firing rate of the burner were calculated over successive one day periods, for the baseline data and the test data, and the average firing rate for the baseline data and the test data over a period of 27 days are shown in Table 2 below. In addition, the cumulative energy consumption of the HVAC system (expressed in British thermal units or BTU) from Mar. 1, 2024 to Mar. 26, 2024 is shown in Table 2 below for the baseline data and for the test data. The building design requirements (in terms of temperature) were met during the acquisition of the baseline data and the test data.

| | Firing rate (%) | BTU |
|---|---|---|
| Baseline data | 46.9% | $608.1 \times 10^6$ |
| Test data | 32.2% | $417.9 \times 10^6$ |
| Savings (%) | 31.3% | 31.3% |

As shown in Table 2, using the process 500, the HVAC system reduces the burner firing rate of 14.7% on average (i.e., over the period of 27 days). As a result, the volumetric airflow rate entering the building was reduced compared to the baseline data. Similarly, using the process 500, the HVAC system reduces the BTU spent by the HVAC system when the process 500 is not implemented by about 31.3%.

Figure 6:
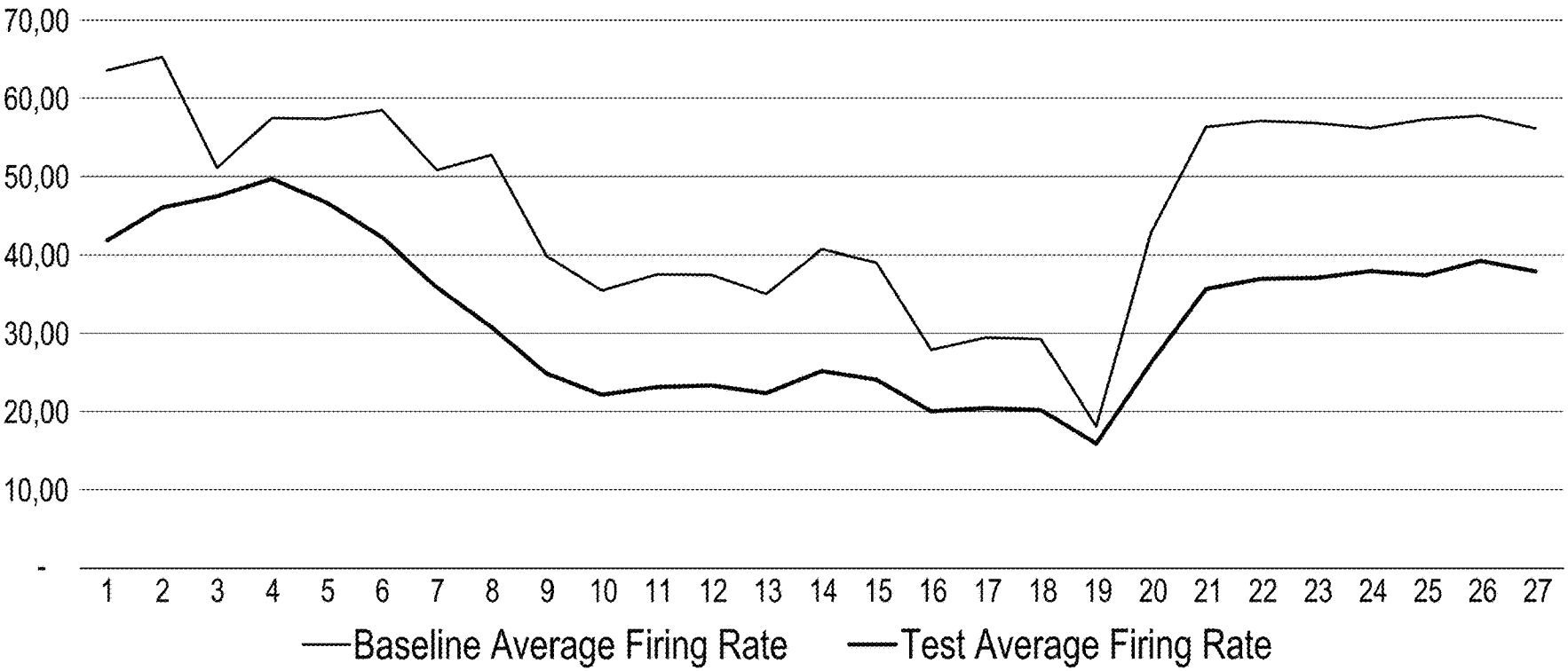
FIG. 6 shows average firing rate data over a 27-day period for a HVAC system with and without implementation of the process of FIG. 5.

FIG. 6 shows the average firing rate for each day of the 27-day period for the baseline data and the test data, the average firing rate being lower on each day for the test data than for the baseline data.

Example 3

Figure 7:
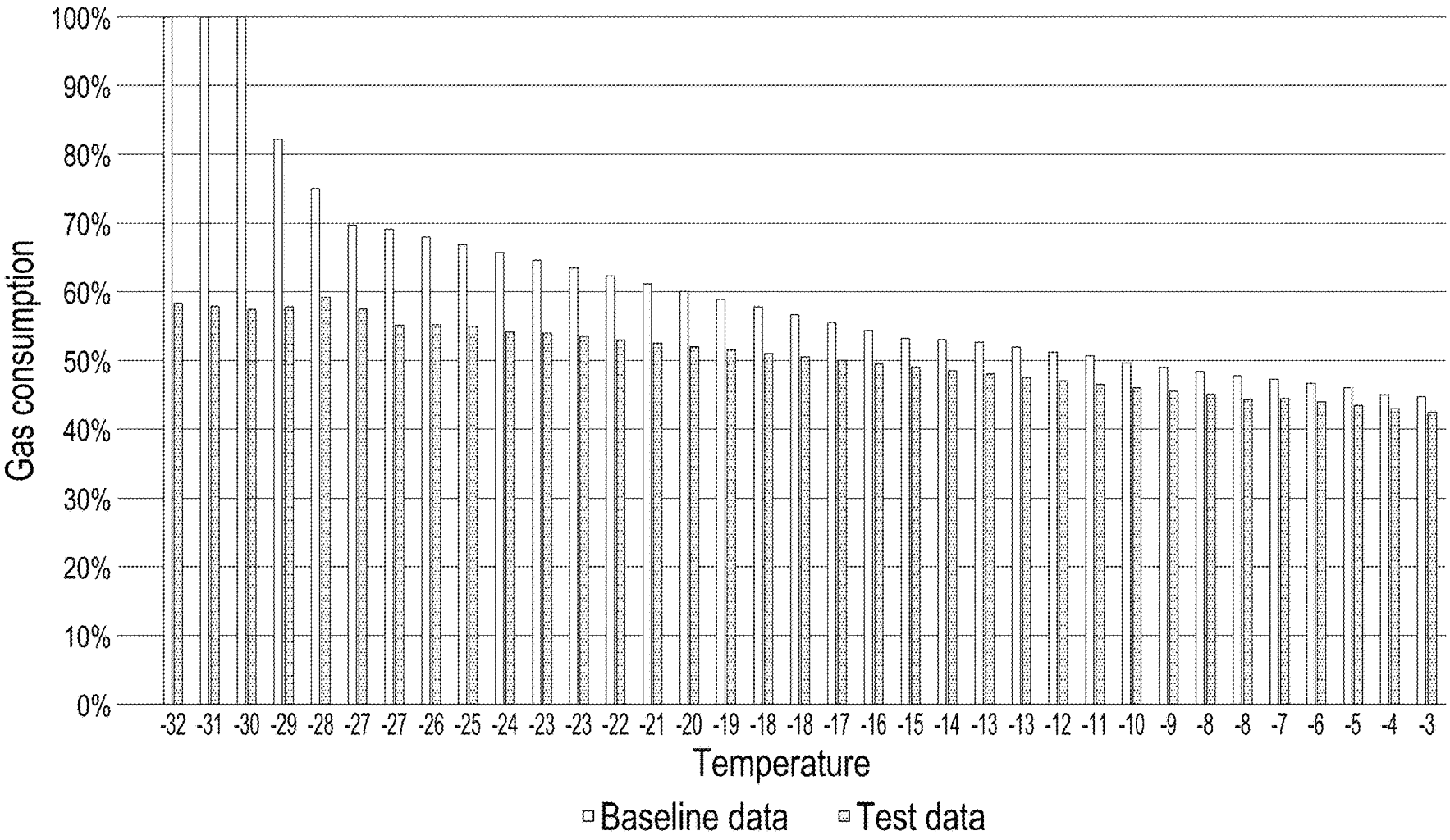
FIG. 7 shows average natural gas consumption at various temperatures for a HVAC system with and without implementation of the process of FIG. 5.

FIG. 7 shows the consumption of natural gas by the HVAC system 100 at various outdoor temperatures, the consumption being lower at each temperature for the test data (i.e., data acquired on the HVAC system when the process 500 was implemented) than for the baseline data (i.e., data acquired on the HVAC system when the process 500 was not implemented).

Having thus described several illustrative embodiments of the present disclosure, those of skill in the art will readily appreciate that yet other embodiments may be made and used within the scope of the claims hereto attached. Numerous advantages of the disclosure covered by this document have been set forth in the foregoing description. It will be understood, however, that this disclosure is, in many respects, only illustrative. Changes may be made in details, particularly in matters of shape, size, and arrangement of parts without exceeding the scope of the disclosure. The disclosure's scope is, of course, defined in the language in which the appended claims are expressed.

It will be apparent that various features described above may be implemented in many different forms of software, firmware, and hardware in the implementations illustrated in the figures. The actual software code or specialized control hardware used to implement the various features is not limiting. Thus, the operation and behavior of the features were described without reference to the specific software code—it being understood that one of ordinary skill in the art would be able to design software and control hardware to implement the various features based on the description herein.

Further, certain portions of the invention may be implemented as "logic" that performs one or more functions. This logic may include hardware, such as one or more processors, microprocessor, application specific integrated circuits, field programmable gate arrays or other processing logic, software, or a combination of hardware and software.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

The invention claimed is:

1. A method of operating a HVAC system for a building defining an interior airspace, the HVAC system comprising a HVAC system blower and a blow through heat exchanger, the HVAC system blower having a HVAC system blower motor, the method being executed by at least one controller operatively connected to the HVAC system, the method comprising:

calculating a temperature differential between a temperature at a discharge region of the blow through heat exchanger and a temperature at an intake region of the blow through heat exchanger;

calculating a volume correction factor based on the calculated temperature differential, wherein the volume correction factor accounts for the thermal expansion of air within the temperature differential;

calculating a modified motor speed according to the volume correction factor; and transmitting a signal comprising an indication of the modified motor speed to cause modification of a speed of the HVAC system blower motor.

2. The method of claim 1, wherein the temperature at the intake region of the blow through heat exchanger is acquired using an intake temperature sensor.

3. The method of claim 1, wherein the HVAC system recirculates at least a portion of the air of the interior airspace towards the intake region.

4. The method of claim 1, wherein the temperature at the discharge region of the blow through heat exchanger is determined using a temperature setpoint of the interior airspace of the building.

5. The method of claim 1, wherein the temperature at the discharge region of the blow through heat exchanger is acquired using a discharge temperature sensor.

6. The method of claim 1, wherein the volume correction factor is calculated using the following formula:

volume correction factor=temperature differential*thermal expansion coefficient.

7. The method of claim 6, wherein the thermal expansion coefficient is 0.00225/° F.

8. The method of claim 6, wherein the modified motor speed is calculated using the following formula:

modified motor speed=(1−volume correction factor) *100.

9. The method of claim 1, wherein the at least one controller transmits the signal comprising an indication of the modified motor speed to a variable frequency drive, the variable frequency drive being operatively connected to the HVAC system blower motor to cause modification of the speed of the HVAC system blower motor.

10. A volume correction controller for a HVAC system for a building defining an interior airspace, the HVAC system comprising a HVAC system blower and a blow through heat exchanger, the HVAC system blower having a HVAC system blower motor, the volume correction controller comprising:

a. a communication interface operatively connected to the HVAC system;

b. a non-transitory storage medium, the non-transitory storage medium storing computer-readable instructions thereon; and c. a processing unit operatively connected to the non-transitory storage medium and the communication interface;

the processing unit, upon executing the computer-readable instructions, being configured for: calculating a temperature differential between a temperature at a discharge region of the blow through heat exchanger and a temperature at an intake region of the blow through heat exchanger; calculating a volume correction factor based on the calculated temperature differential, wherein the volume correction factor accounts for the thermal expansion of air within the temperature differential; calculating a modified motor speed according to the volume correction factor; and transmitting a signal comprising an indication of the modified motor speed to cause modification of a speed of the HVAC system blower motor.

11. The volume correction controller of claim 10, wherein the communication interface is operatively connected to an intake temperature sensor configured to acquire the temperature at the intake region of the blow through heat exchanger.

12. The volume correction controller of claim 11, wherein the HVAC system recirculates at least a portion of the air of the interior airspace towards the intake region.

13. The volume correction controller of claim 10, wherein the temperature at the discharge region of the blow through heat exchanger is determined using the temperature setpoint of the interior airspace of the building.

14. The volume correction controller of claim 10, wherein the communication interface is operatively connected to a discharge temperature sensor configured to acquire the temperature at the discharge region of the blow through heat exchanger.

15. The volume correction controller of claim 10, wherein the processing unit, upon executing the computer-readable instructions, is configured for calculating the volume correction factor using the following formula:

volume correction factor=temperature differential*thermal expansion coefficient

16. The volume correction controller of claim 15, wherein the thermal expansion coefficient is 0.00225/° F.

17. The volume correction controller of claim 15, wherein the processing unit, upon executing the computer-readable instructions, is configured for calculating the modified motor speed using the following formula:

modified motor speed=(1−volume correction factor) *100.

18. The volume correction controller of claim 10, wherein the communication interface is operatively connected to a variable frequency drive and is configured to transmit an indication of the modified blower motor speed to the variable frequency drive, the variable frequency drive being operatively connected to the HVAC system blower motor to cause modification of the speed of the HVAC system blower motor.

* * * * *